US009085888B2

(12) United States Patent
Fuller et al.

(10) Patent No.: US 9,085,888 B2
(45) Date of Patent: Jul. 21, 2015

(54) STRUCTURAL SUPPORT SPACER

(71) Applicant: Kevin S. Fuller, Lake Elmo, MN (US)

(72) Inventors: Kevin S. Fuller, Lake Elmo, MN (US); Wayde J. Altendorf, Hickson, ND (US); Stephen J. Ware, Columbus, OH (US); Allen J. Bishop, Cardington, OH (US)

(73) Assignee: Kevin S. Fuller, Lake Elmo, MN (US)

( * ) Notice: Subject to any disclaimer, the term of this patent is extended or adjusted under 35 U.S.C. 154(b) by 0 days.

(21) Appl. No.: 14/079,567

(22) Filed: Nov. 13, 2013

(65) Prior Publication Data

US 2014/0130442 A1 May 15, 2014

Related U.S. Application Data

(60) Provisional application No. 61/725,995, filed on Nov. 13, 2012.

(51) Int. Cl.

| | |
|---|---|
| ***E04B 1/38*** | (2006.01) |
| ***E04C 5/00*** | (2006.01) |
| ***E04B 7/02*** | (2006.01) |
| ***E04G 25/00*** | (2006.01) |

(52) U.S. Cl.
CPC ..... *E04B 7/024* (2013.01); *E04G 25/00* (2013.01)

(58) Field of Classification Search
CPC ..... E04B 7/022; E04B 7/024; E04B 1/2608; E04B 1/2612; E04C 2003/026; E04C 3/02; E04C 3/12; E04G 25/00
USPC ..... 52/696, 690, 633, 693
See application file for complete search history.

(56) References Cited

U.S. PATENT DOCUMENTS

| | | | | | |
|---|---|---|---|---|---|
| 3,102,306 | A | * | 9/1963 | Hutchinson | 29/897.3 |
| 4,246,736 | A | * | 1/1981 | Kovar et al. | 52/696 |
| 4,490,956 | A | * | 1/1985 | Palacio et al. | 52/639 |
| 4,669,235 | A | * | 6/1987 | Reinen | 52/98 |
| 5,580,036 | A | * | 12/1996 | Browning | 269/37 |
| 5,606,837 | A | * | 3/1997 | Holizlander | 52/693 |

(Continued)

FOREIGN PATENT DOCUMENTS

AU 2002313378 12/2002

OTHER PUBLICATIONS

Brochure by Metricon, Metricon puts Safety First, 2 pages, Australia, at least as early as Nov. 2012.

(Continued)

*Primary Examiner* — Mark Wendell
(74) *Attorney, Agent, or Firm* — Christensen Fonder P.A.

(57) ABSTRACT

This disclosure relates to building trades where precise spacing between structural members ensures support via use of a plurality of elongate spacers. The spacers include at least one intermediate transit tacking member and a pair of nail- or screw-receiving apertures on opposing ends of thereof. One of the opposing ends serves as a pivoting end and the opposite end includes one or more relatively shorter member near the aperture formed therein. These member(s) can be driven into an adjacent trust or other support member while a final precise position is determined. To determine the final precise position to affix a given spacer one or more indicia is provided. Such indicia can include end edges, one or more cut-out features and/or one or more cut-out features and/or numbered or lettered (or other symbols) indicating the relative spacing from one end of the elongate spacer to the other.

20 Claims, 7 Drawing Sheets

(56) References Cited

U.S. PATENT DOCUMENTS

| | | | | |
|---|---|---|---|---|
| 5,884,448 | A * | 3/1999 | Pellock | 52/643 |
| 5,893,253 | A * | 4/1999 | Lutz, III | 52/695 |
| 5,899,042 | A * | 5/1999 | Pellock | 52/696 |
| 6,354,055 | B1 * | 3/2002 | Shaw et al. | 52/712 |
| 6,393,794 | B1 * | 5/2002 | Pellock | 52/696 |
| 6,418,695 | B1 * | 7/2002 | Daudet et al. | 52/677 |
| 6,993,882 | B2 * | 2/2006 | Crawford et al. | 52/696 |
| 7,213,377 | B1 | 5/2007 | Sackett | |
| 7,377,048 | B2 * | 5/2008 | Koetter | 33/613 |
| 8,176,648 | B2 | 5/2012 | Bradley | |
| 8,191,335 | B2 | 6/2012 | Davis | |
| 2002/0092259 | A1 | 7/2002 | Crawford et al. | |
| 2006/0196068 | A1 * | 9/2006 | Thompson et al. | 33/613 |
| 2009/0151294 | A1 * | 6/2009 | Staley | 52/655.1 |
| 2011/0154770 | A1 | 6/2011 | Friis | |
| 2012/0159896 | A1 * | 6/2012 | Lin | 52/848 |
| 2012/0180422 | A1 | 7/2012 | Noturno | |

OTHER PUBLICATIONS

Duvoisin, Robert, Safety and Speed Make Truss Spacers an On-Site Winner, MiTek, Melbourne Australia, 3 pages, at least as early as Nov. 2012.

Brochure of Gang-Nail® Truss Spacer Installation Instructions, MiTek®, 1 page, at least as early as Nov. 2012.

* cited by examiner

A - NO STEP
A - NO STEP
60
58
64
48
52
40

46
56

81
84
88
52
44
48
58
48

52
80
46
56
86
84
22

84
88
86
52

44
42

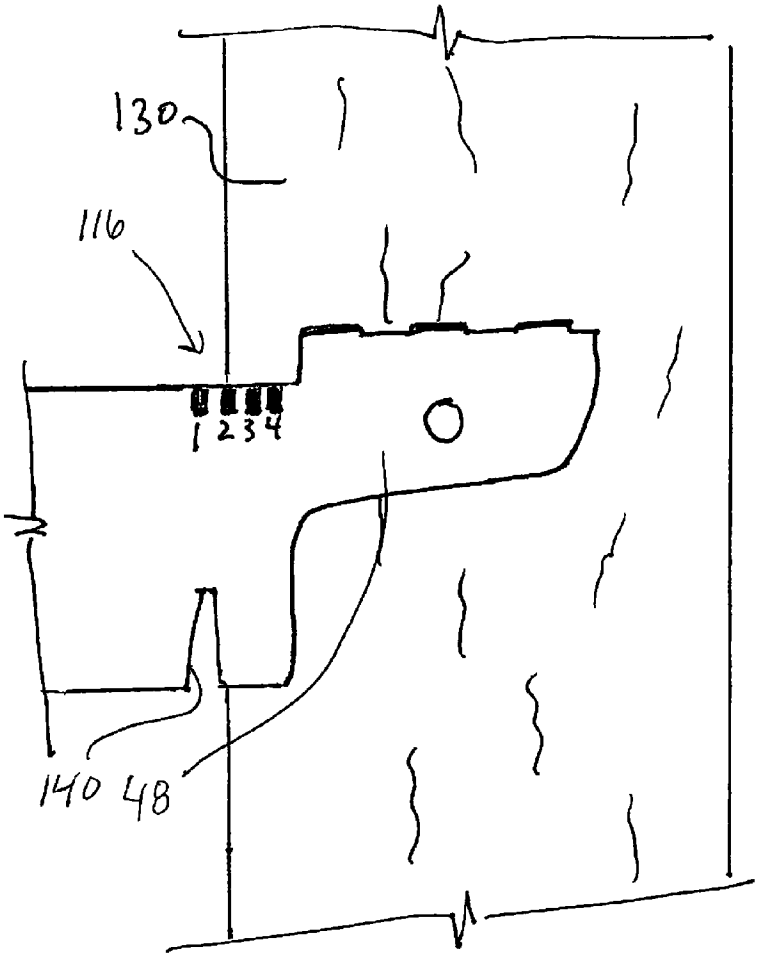
FIG. 15
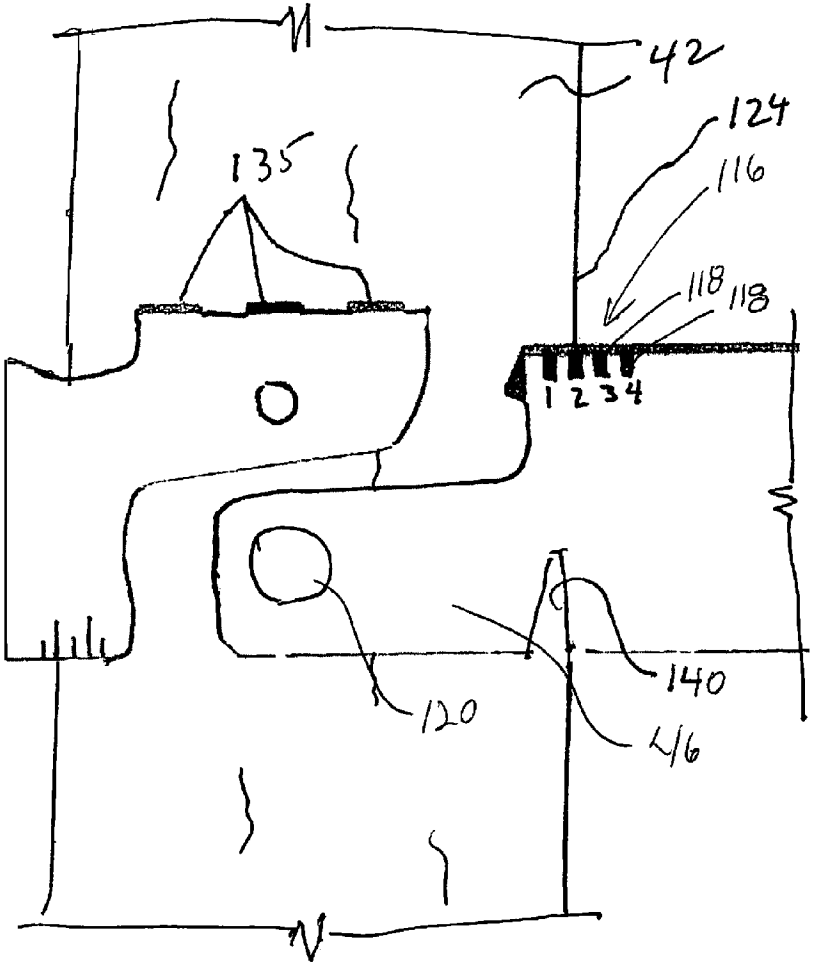

STRUCTURAL SUPPORT SPACER

PRIORITY CLAIM

This application claims priority to U.S. Provisional Application No. 61/725,995, filed on Nov. 13, 2012, the entire contents of which is incorporated herein by reference.

FIELD OF THE INVENTION

The invention relates to a family of alignment, spacing, and attachment methods and apparatus providing for the precise positioning of framing members in the construction of various structures such as wood framed buildings; in particular, the disclosure relates to unitary members that temporarily couple to pre-fabricated trusses or the like during transit or before final positioning the truss as part of the structure to a building site and then are easily, efficiently, and accurately uncoupled, rotated, and tacked into precise position between adjacent truss members.

BACKGROUND OF THE INVENTION

Accurate placement of structural support members such as beams, joists, rafters, and particularly roof trusses can require several manual steps (e.g., measuring, positioning, re-measuring, temporarily tacking or bracing the members, etc.) that can result in tedious progress and less than safe intermediate placement as the framing members are erected into a building.

Many different approaches, as well as several patented apparatus and methods have been applied to reduce the time and increase the safety of building structural support structures. For example, Australian patent number AU 20022313378 owned by Mitek Holdings, Inc. issued 15 Mar. 2007 and is captioned, "Building Frame Member and Brace," and deals with some of the foregoing issues and problems encountered by tradesmen attempting to fabricate structural support frame elements. The Brace of AU 20022313378 provides a brace with a pivotal connection and a free swinging end. The brace thus has a first transport and handling position and then rotates to a second use position; however, the '378 brace does not lay flush against the surface of the structural support member when in the first transport and handling position, rather it extends upwardly exposing metal corners presenting a safety hazard to workers and subjecting the brace to damage by contact with other things during handling, storage, or transport. Moreover, the brace does not have additional means for retaining the brace in the first transport and handling position and may swing loose during handling, such as hoisting the structural support member into position in the framing. This can create safety issues and additional assembly problems, particularly if the brace is damaged. Moreover, compensation means are not provided by the '378 brace for when the first pivotal connection is not accurately fastened to the structural support member. Moreover, in that each end of the '378 brace extends entirely over both structural support members that it spans between, uniform positioning of the brace on adjacent structural support members is not possible in that the brace ends would overlap. Thus, staggering and offsetting the braces when applied to the structural support members is required.

More recently U.S. Pat. No. 8,191,335 captioned, "Framing Guide" issued to Mark K. Davis on 5 Jun. 2012; U.S. Pat. No. 8,176,648 captioned, "Construction Spacer" issued to Bret Bradley on 15 May 2012; U.S. Pat. No. 7,213,377 captioned, "Device and Method for Spacing and Bracing Framing Components" issued to Gerald Sackett on 8 May 2007; and U.S. Pat. No. 6,993,882 captioned, "Truss Spacer and Brace" issued to Crawford et al. on 7 Feb. 2006. Prior to the issuance of the Australian '378 patent U.S. Pat. No. 5,884,448 captioned, "Truss Spacer and Support, Method of Use and Structures Made Therewith" issued to Michael Pellock on 23 Mar. 1999. Each of the foregoing issued patents are hereby incorporated herein in their respective entirety as if fully set forth herein.

In addition to these issued patents at least two recently published U.S. patent applications deal with some of the issues addressed by the present disclosure; namely, U.S. published patent applications nos. 2012/0180422 to Sam Norturno (published 19 Jul. 2012) captioned "Truss Spacer" and 2011/054770 to Niels Friis of Denmark (published 30 Jun. 2011) captioned "Truss Mounting Brace." These two published applications are also hereby incorporated herein in their respective entireties.

Generally, known spacers are attached during positioning of the framing members during the erection of the structure when the framing members are positioned in the final or near final positions in the structure. This involves manual attachment operation on both ends of the spacer on elevated structural members. It would be beneficial to minimize the number of operations and the simplicity of operations related to utilizing spacers on elevated structural members. Fewer operations and simpler operations on elevated structural members provide a safer and more efficient framing operation.

Roof trusses are manufactured in truss manufacturing facilities and are shipped bundled in stacks, to job sites where they are generally individually elevated to their final support position and nailed into place. It would be advantageous to attach spacers before hoisting the trusses to their final support position. It also would be advantageous that the spacers are secured to the truss or other structural support member during any transportation, handling, hoisting to their final position. It would also be advantageous to have the spacers have minimal portions protruding away from the truss during such transportation, handling, and hoisting of the trusses.

SUMMARY OF THE INVENTION

Precise spacing between structural framing members, such as roof trusses, is provided by way of a plurality of pivoting elongate spacers. After a particular framing member has been secured in place on the wood framed structure, one end of the spacer is manually grasped and rotated away from a nesting position on the structural support member releasing a temporary attachment portion, such as a shallow integral prong in a midportion of the spacer, swung out to a position approximately 90 degrees from the particular framing member. The released end is utilized to provide the correct spacing between the particular member and an adjacent member and attaches to the adjacent member. In an embodiment, each spacer has a first pivot end, about which the spacer pivots, an intermediate portion having an intermediate transit tacking member, such as a prong, and a second swing end, the second end, opposite the first end, includes means for attachment to an adjacent truss to be positioned. The means for attachment can include a preliminary attachment means and permanent attachment means. The preliminary attachment means can include prongs unitary with the spacer positioned at the second end. The permanent attachment means may include nail or screw receiving apertures in the second end or unitary prong or prongs.

In embodiments of the invention, a truss spacing measurement and correction means is provided with each spacer and may be indentations, grooves, markings, or other indicia on the first pivot point end portion of the spacer, to provide a graded indicators for an indication if the first end of the spacer is positioned correctly on the respective structural support member and if not, a measurement of how much correction is needed on the adjacent truss to which the spacer will be connected. Then when positioning the adjacent truss utilizing the spacer, the edge of the adjacent truss is aligned with specific point on the graded indicators on the second swing end portion corresponding to the measurement provided by the graded indicators on the first pivot point end portion. Thus, the spacer may allow variability in the attachment of the spacers on the trusses at the truss manufacturing facility or at the job site whilst still providing a convenient correction means.

In determining the final, precise, position to affix a given spacer to the adjacent truss, the graded indicators may be one or more indicia provided in, on, or to the spacer. In one form such indicia includes one or more cut-out features (e.g., a V-shaped cut, an I-shaped cut, or the like) in other forms the indicia includes either one or more cut-out features and/or numbered or lettered (or other symbols) indicating the relative spacing from one end of the elongate spacer to the other (or simply from a first indicia to an opposing indicia or set of indicia).

One of the opposing ends serves as a pivoting end and the opposite end includes one or more (e.g., three) relatively shorter pegs, spikes, or protrusions near the apertures formed therein. These pegs, spikes, or protrusions can be driven into an adjacent trust or other support member as the final, precise, position is determined. Then a nail or other permanent fastener may also be utilized.

The spacer can be formed of myriad materials such as metal or alloys, resin-based materials (e.g., extruded, co-extruded, or injection molded whether basic, reaction-injection molded, or whether combined with fibers for reinforcement, etc.), composite wood or hybrid composite materials, combinations thereof, and the like. The materials can be tempered to enhance the structural qualities thereof or cured in the case of resin-based materials, for example. In one form, 20 gauge (20 GA) galvanized sheet metal is used to fabricate the spacers although materials and gauges of sheet metal can of course be used.

In one form the elongate spacer has an L- or V-shaped shaped cross-section which can have equal or unequal lengths as measured from a common junction therebetween. Thus, in a relatively simple sheet metal fabrication process the elongate spacers can be cut from a flat sheet and then bent into an L- or V-shaped structure with a metal working brake or other apparatus and the at least one intermediate transit tacking member can be manually bent and positioned for engagement prior to shipment of the truss (or trusses) to which they attach. In lieu of an integral prong member other forms of temporarily attaching an elongate spacer can be used; however, several advantages can be appreciated with a unitary spacer such as depicted and described herein below. Known techniques for efficiently automatically laying out and cutting individual spacers (or other discrete piece-parts) from larger raw stock, such as sheet metal exist and can be employed in the early stages of fabrication. These include computer-assisted plasma cutting tools, computer-numerical-control (CNC) metal cutting tools, metal lathes and other plate or sheet metal cutting machines and the like.

Such spacers may be conveniently attached at the truss manufacturer in a transit position laying flush along an upper surface of the framing members, or nearly flush, before the framing members are hoisted into position.

Other indicia can be engraved, written, or printed upon the elongate spacers such as trade names, trademarks, instructions for use, warnings (e.g., "no step" or similar—akin to the stickers or printing applied to portions of aircraft), color-coded messages (e.g., relating to the gauge or structural rating, desired truss dimension(s) or load-bearing capacity of the metal or other material used to fabricate a given spacer), an "up" side versus a "down" side for the spacer, and the like.

Also, in particular embodiments, the spacers may come as a set with one grouping being for placement on one side of the angled pieces of roof trusses, and the other grouping may be configured as a mirror image to be attached to the opposite (that is left side and then right side). The two mirror image configurations allow the first pivot point end portion to be attached toward the apex of each of the roof trusses. This provides some safety in the transport and handling position of the spacers attached to the trusses in that the second end portion is lower and less likely to separate as compared to if the first end portion was mounted below the second end portion.

In the event that the truss spacers are aligned longitudinally across two or more truss members, the ends can be fabricated so that they essentially overlap without contacting each other. In one form, the ends are simply L-shaped or angled so that they cooperatively align but do not physically overlap when affixed in a nearly-abutting configuration on an upper (or lower) surface of a single truss member. Thus, as depicted and described hereinbelow, a pivoting end of a first truss spacer can be affixed to a portion of a surface of a single truss in a nearly-abutting configuration to the swing end of a second truss spacer.

The family of truss spacers disclosed, depicted, and claimed herein can be used in addition to or in lieu of other spacing members (e.g., temporary or permanent wooden cross-members, or bridging boards or planks).

The truss spacers can include an orthogonal (i.e., perpendicular relative to a longitudinal axis) or oblique angled face on the side of the L- or V-shaped form of the spacers, which in the former instance will tend to positively engage a major surface of the truss the spacer couples to and provide a modicum of added rigidity or support to the combined structures.

A feature and advantage of embodiments of the invention is a spacer configured as an elongate thin strip portion with a first pivot point end comprising a receiving region, such as a hole for receiving a nail or other fastener, a temporary attachment portion displaced from the first pivot point end, the temporary attachment portion having a single impact attachment means, and a second swinging end with a second end first attachment means. In embodiments the second swinging end may have a second attachment means wherein one of the first and second attachment means is an initial securement means of a first securement level, and the other of the first and second attachment means provides a greater securement level expected to be permanent. For example the initial securement means may be one or more integral prongs for temporary attachment of the second means and the other is an aperture for receiving a nail for permanent attachment of the second swinging end. In an embodiment, the temporary attachment portion displaced from the first pivot point end that has an impact portion and an integral prong portion with both positioned above a primary surface of the spacer.

A feature and advantage of embodiments of the invention is the temporary attachment means allows the spacer to be positioned flush against the upwardly facing surface of the structural support member before the temporary attachment means is activated, that is for example, hit with a hammer to drive an elevated prong into the upwardly facing surface of the structural support member to temporarily secure the spacer in the first transport and handling position.

A feature and advantage of embodiments of the invention is that the spacers are stackable. In an embodiment with the temporary attachment means comprising an elevated prong, the elevated prong extends above an aperture in the exposed upward strip portion such that the prongs of the stack nest together providing securement of the stack.

In an embodiment of the invention, the first pivot point end portion and the second swing end have spacing assurance graded indicators to assure correct spacing between the pair of structural support members spanned by the spacer even if the first pivot point attachment was not at the correct, optimal and/or desired position. The first pivot point end having a pivot point misplacement graded indicia providing information by noting where the edge of the upwardly facing surface aligns with the graded indicia reflecting the misplacement of pivot point and indicating the positioning adjustment needed at the second end. The second swing end has adjustment indicator correction indicia whereby the edge of the upwardly facing surface of the structural support member is positioned at the corresponding graded indicia on the second end that corresponds with the indication provided at the first end.

A feature and advantage of embodiments of the invention is that the spacers may be applied to all of the structural support members at the same location, for example the same distance from the apex of the roof truss, on adjacent structural support members. Each end portion in embodiments of the invention are configured to allow the end portions to nest together, with one end configured as a tab positioned on one lateral side of the two lateral sides of the upward exposed strip portion of the spacer and the other end having a tab positioned on the other of the two lateral sides. The ends may nest together such that the width of the nested connection is substantially the width of the mid portion of the spacer spanning between the spaced structural support members. Alternatively, the tab at the second swinging end may extend laterally beyond the edge of the upward exposed strip portion of the spacer.

In embodiments of the invention, the spacers are attached to trusses at the place of manufacture of the trusses and are shipped to the job site attached. The intermediate attachment means secures the spaces on the trusses. In certain embodiments, the spacers can be installed as each individual truss is being assembled. The first end is pivotally attached, such as be a separate nail or a prong on the spacer. The intermediate portion is temporarily secured such as be a unitary shallow prong (or a staple, or adhesive means), shallow enough to permit hand removal of the spacer attachment to the truss at the intermediate portion. Such truss manufacturing is often automated and the spacers can be added by such automated equipment. Then at the job site the trusses are hoisted into position and the spacers pivoted out to their spacing position by releasing the intermediate attachment and are utilized with the spacing indicators at the second end for the spacing of the adjacent truss and secured into position on the adjacent truss.

While the brief summary provided above provides some insight into the depth and breadth of the content of the instant disclosure other forms, embodiments, combination, modifications, substitutions, and insubstantial changes can be made by those of skill in the art without departing from the true scope hereof. All such other forms and the like are intended to be fully covered hereby as more specifically set forth in the appended claims and taken in context of the entire specification and drawings.

BRIEF DESCRIPTION OF THE DRAWINGS

FIG. 15 is a detailed plan view of graded indicators on end portions of spacers in accord with the inventions herein.

DETAILED DESCRIPTION

Figure 1:
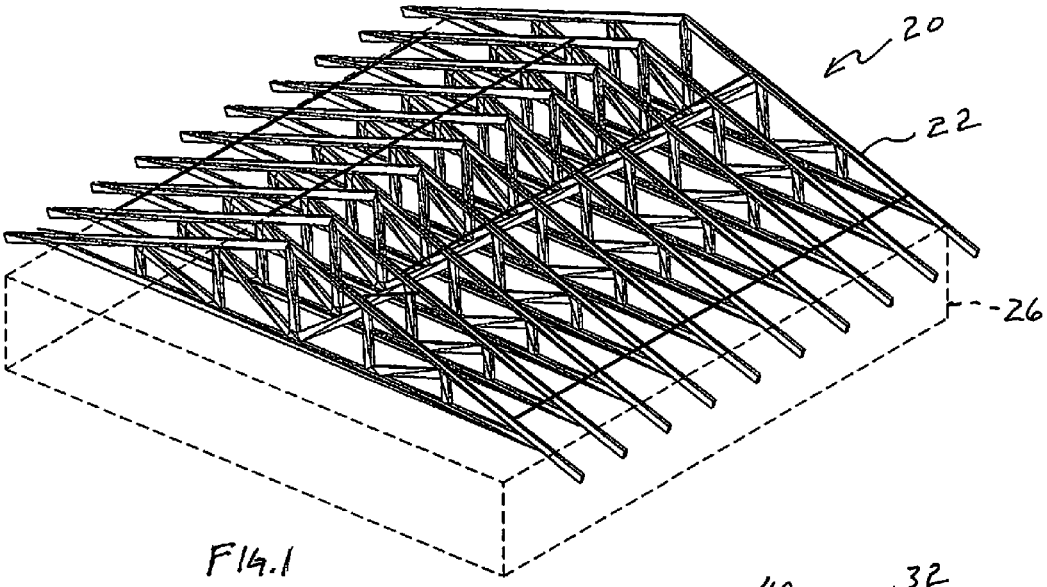
FIG. 1 is a perspective view of the framing of a building with structural support members and spacers in accord with embodiments of the inventions herein.
Figure 2:
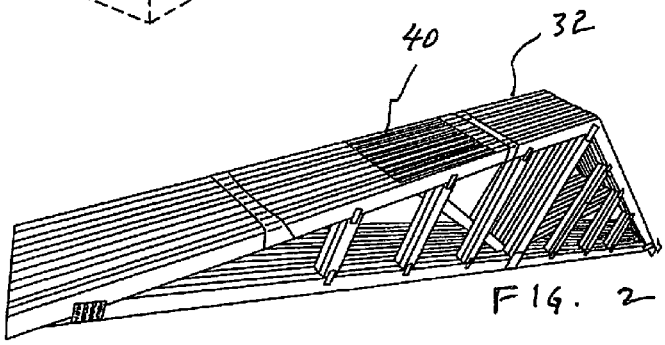
FIG. 2 is a stack of roofing trusses in a stack with spacers in accord with embodiments of the invention herein.
Figure 3:
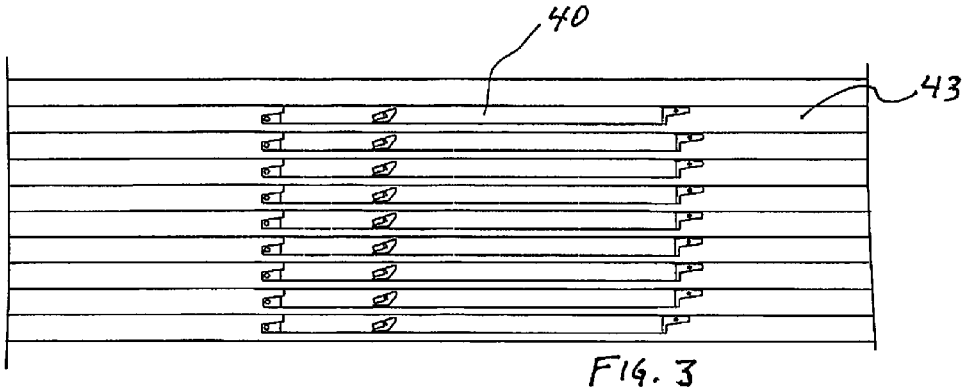
FIG. 3 is a plan view of the trusses of FIG. 2 with spaces.
Figures 4, 5, 5A, 6, 7, 8, 9:
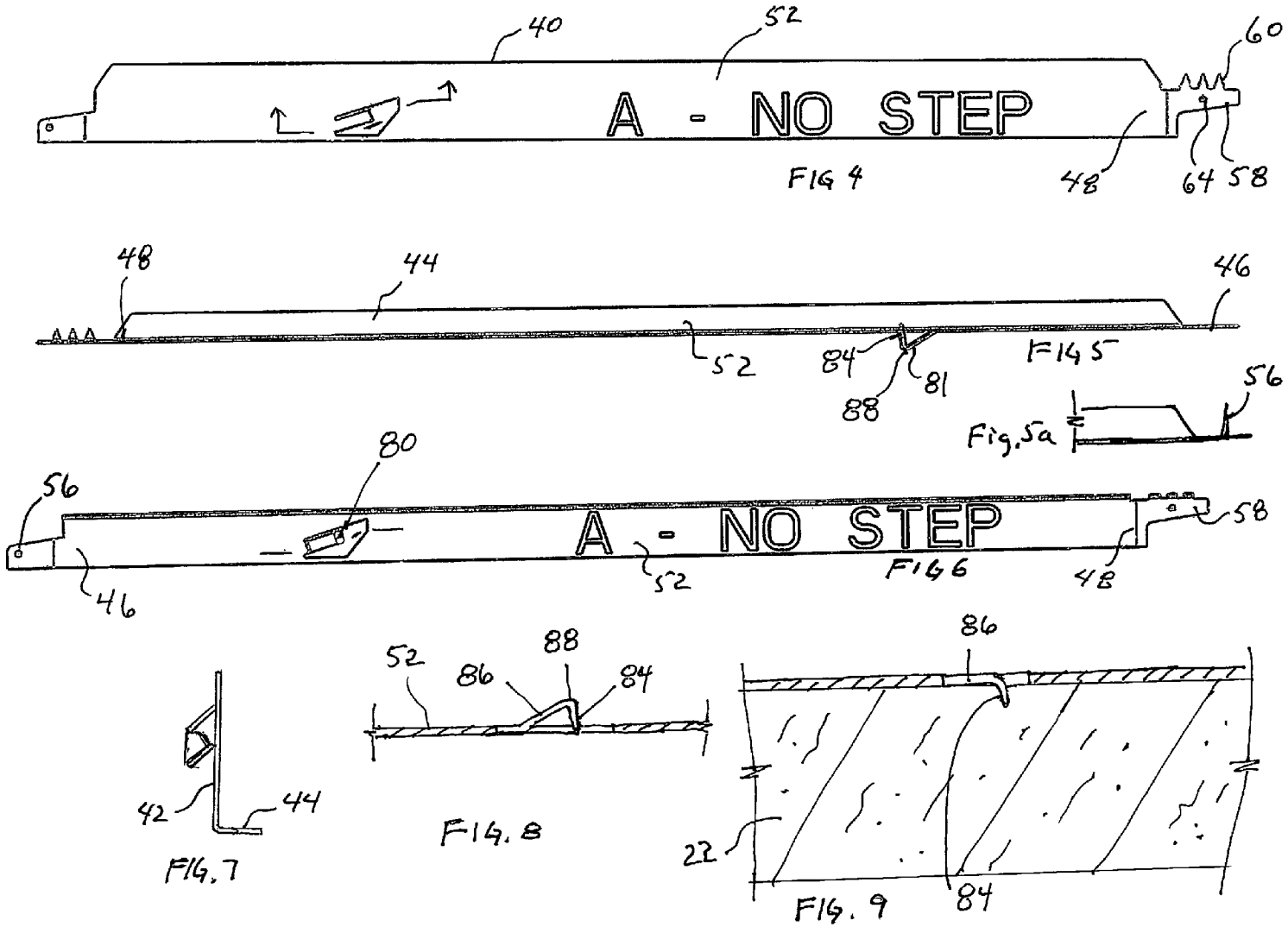
FIG. 4 is a top plan view of a spacer for structural support members such as roof trusses in accord with embodiments of the inventions herein.
FIG. 5 is a side elevational view of the spacer of FIG. 4.
FIG. 5*a* illustrates a view of a spacer as in FIG. 5 with a prong as a first attachment means.
FIG. 6 is a bottom plan view of the spacer of FIGS. 4 and 5.
FIG. 7 is an end view of the spacer of FIGS. 3-6.
FIG. 8 is a cross sectional view taken at line 8-8 of FIG. 4 illustrating a temporary attachment means of a spacer in accord with the inventions herein.
FIG. 9 is the spacer of FIG. 8 attached to a structural support member, with the prong embedded in the wood of the structural support member.
Figure 10:
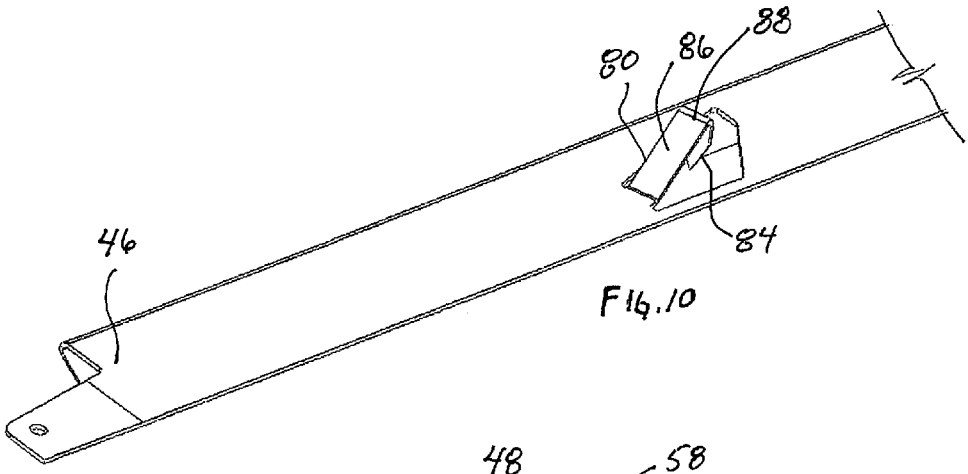
FIG. 10 is a perspective view of a first pivot point end of a spacer in accord with embodiments of the inventions herein.
Figure 11:
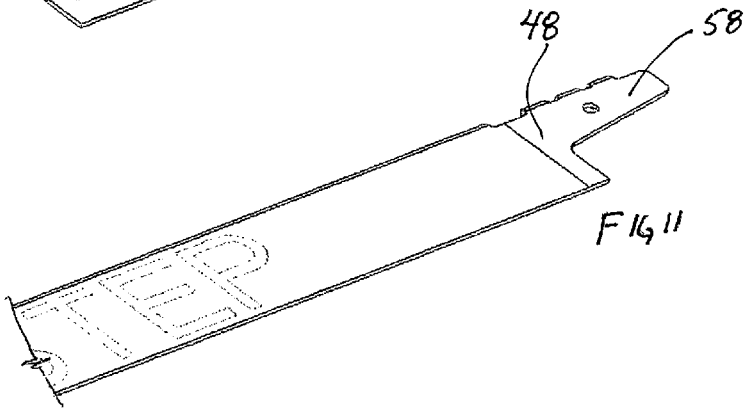
FIG. 11 is a perspective view of the second swing end of a spacer in accord with embodiments of the inventions herein.
Figure 12:
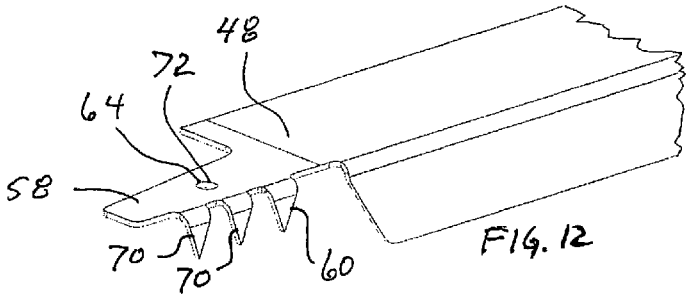
FIG. 12 is a perspective view of the second swing end of the spacer of FIG. 10 from the opposite side.
Figure 13:
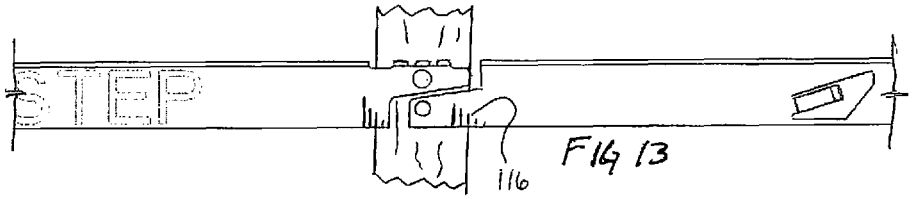
FIG. 13 is a plan view of two spacers connected to a truss in accord with embodiments of the inventions herein.

Referring to FIG. 1, the framing of a wood frame building 20 is illustrated. Structural support members 22, configured as planar roof trusses rest on a building wall structure 26 shown in dashed lines. FIG. 2 illustrates a stack 32 of such roof trusses bound together as they would be shipped to the job site from a truss manufacturing facility. The trusses of the wood frame building have spacers 40 in place for maintaining the spacing between the trusses during erection of the building. The spacers 40 are illustrated on the trusses in the stack of trusses in a transport and handling position, laying flush against an upwardly facing surface 43 of the trusses. FIG. 1 illustrates most of the spacers in a use position extending at or about 90 degrees from the planar trusses.

FIGS. 4-13 provides several detailed views of an exemplary structural support member spacer 40 according to certain embodiments. The spacer may conveniently be formed from sheet metal; other materials such as polymers, composites, wood products may be suitable for certain embodiments. The spacer as illustrated comprises a first elongate strip portion 42 and a unitary second strip portion 44 positioned at a right angle forming an L-shape in cross section, see FIG. 7. The spacer 40 further has a first pivot point end portion 46 and second opposite swing end portion 48, with an end edge 49, and an intermediate portion 52 extending between the end portions. The first pivot point end portion 46 has a first tab 54 and a first attachment means 56 configured as aperture that can receive a nail, screw, or other fastener. In certain embodiments the attachment means may be a single prong formed integral with the strip portion 42. The tab is of a lesser width than the width of the first elongate strip portion at the intermediate portion. The first attachment means provides a pivot point about which the spacer, specifically, the second swing end portion 48 and the intermediate portion 52 of the spacer may rotate.

The second swing end portion 48 has a second tab 58 and a second attachment means 60 and a third attachment means 64. The second attachment means 60 may be a temporary and removable attachment means used for adjustment of the positioning of the truss being connected. That is, the second attachment means 60 may be a plurality of shallow prongs 70, for example less than ⅜ inches long, that may be tacked onto the adjacent truss that is being positioned. If the positioning is not quite correct, a tap under the spacer with a hammer can release the second swing end portion. A nail, screw, or other fastener may be part of the third attachment means 64 and be inserted in the aperture 72 for permanent attachment of the second swing end portion 48. In other embodiments the second attachment means 60 may be an adhesive that provides a temporary attachment, or tape that secures the spacer.

Shown separated from the first pivot point end portion 46 is a temporary transit securement means 80 for maintaining the spacer in the transport and handling position and laying flush against the structural support member a length of the spacer, at least from the first pivot point attachment end to the temporary transit securement means. In the embodiment illustrated the temporary transit securement means 80 is positioned at the intermediate portion at least several inches from the first pivot point end portion. In the embodiment illustrated, see FIGS. 4-13, an elevated prong 84 unitary with and attached to the strip portion by way of an angled connection piece 86 that also provides a strike surface 88 for a hammer to embed the prong into the wood structural support member 22. See FIGS. 8 and 9. Note that in particular embodiments, the temporary transit securement means may be at the second swing end. In certain embodiments, means other than the prong may be utilized such tacks, staples, or adhesive.

The opposing end portions 46, 48 includes complementary and cooperating cut-out portions defining the tabs 54, 58 so that when more than three truss members are coupled with the spacers the end features do not overlap, although they allow for linear support between the truss members. The ends may be nearly abutting but without physically overlap.

Referring to FIGS. 13, 14, 15, 16 the alignment indicator or placement indicia 116 provided at each end portion 46, 48 can be the actual end edge 49 or spaced from the actual end edge and can be disposed on either or both lateral sides of the respective end portions thereof. The graded indicators 118 on the first end portion provide information as to the correct placement, width wise, of the pivot point 120 of the first end portion. The edge 124 of the structural support member 42 as aligned with the indicia 116 provide information as to the positioning of the pivot point. During positioning of the adjacent structural support member 130, the structural support member is adjusted with respect to its position such that the same identified graded indicator is aligned with the edge of the adjacent member 130. This assures correct spacing between the two trusses. The second swing end portion 48 may also includes integral structure(s) 135, such as prongs configured to pierce a surface of the upwardly facing surface of the adjacent member, such as a truss. Various other indicia 140 such as notches can be formed or printed on either side of the spacer as the graded indicators. Other indicia may provide instructions, warnings, structural support constraints, source or origin information and the like to the end and subsequent users or viewers of one or more of the spacers.

Figure 14:
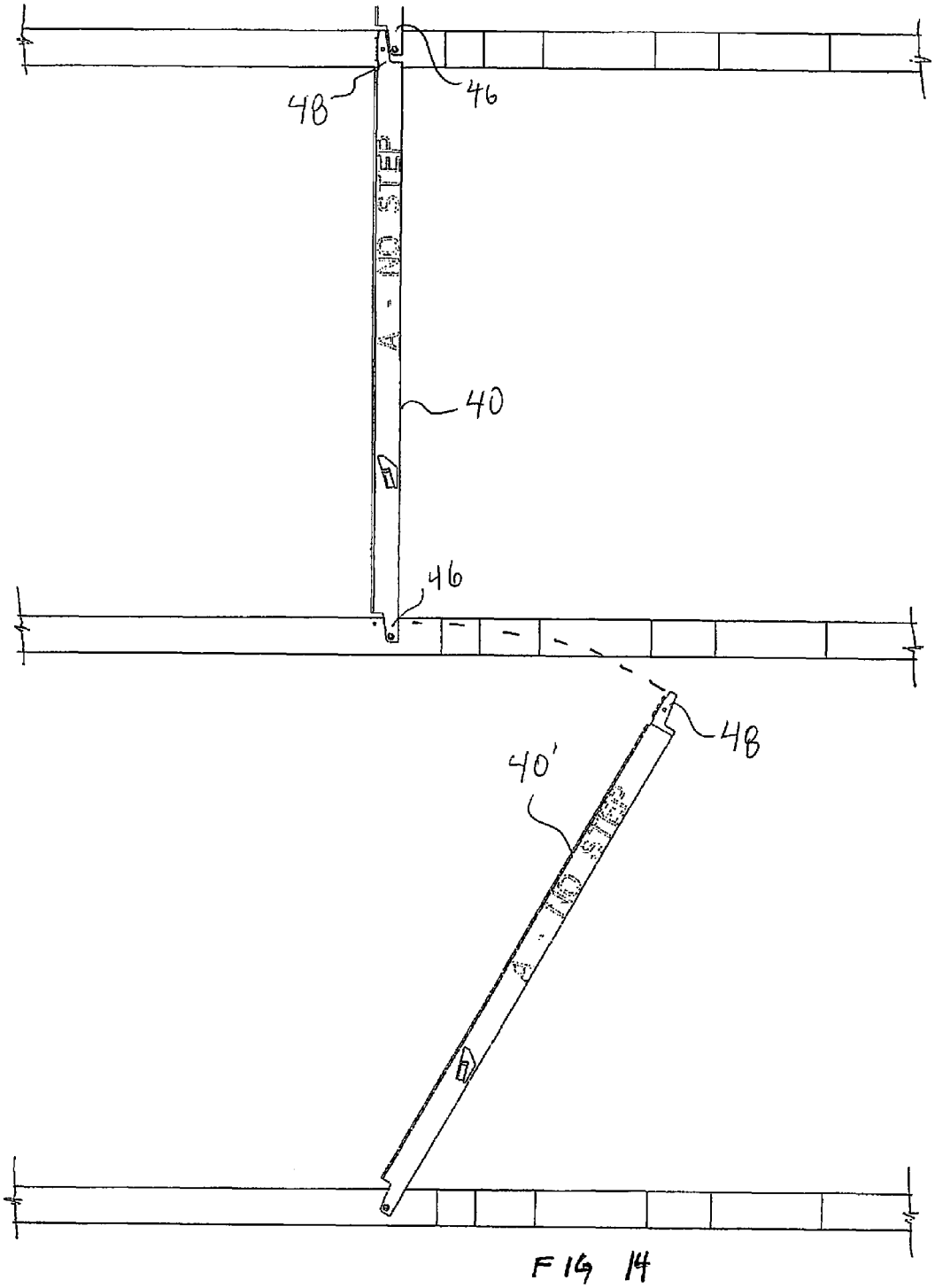
FIG. 14 is a plan view of three trusses and spacers according to embodiments of the inventions herein.
Figure 16:
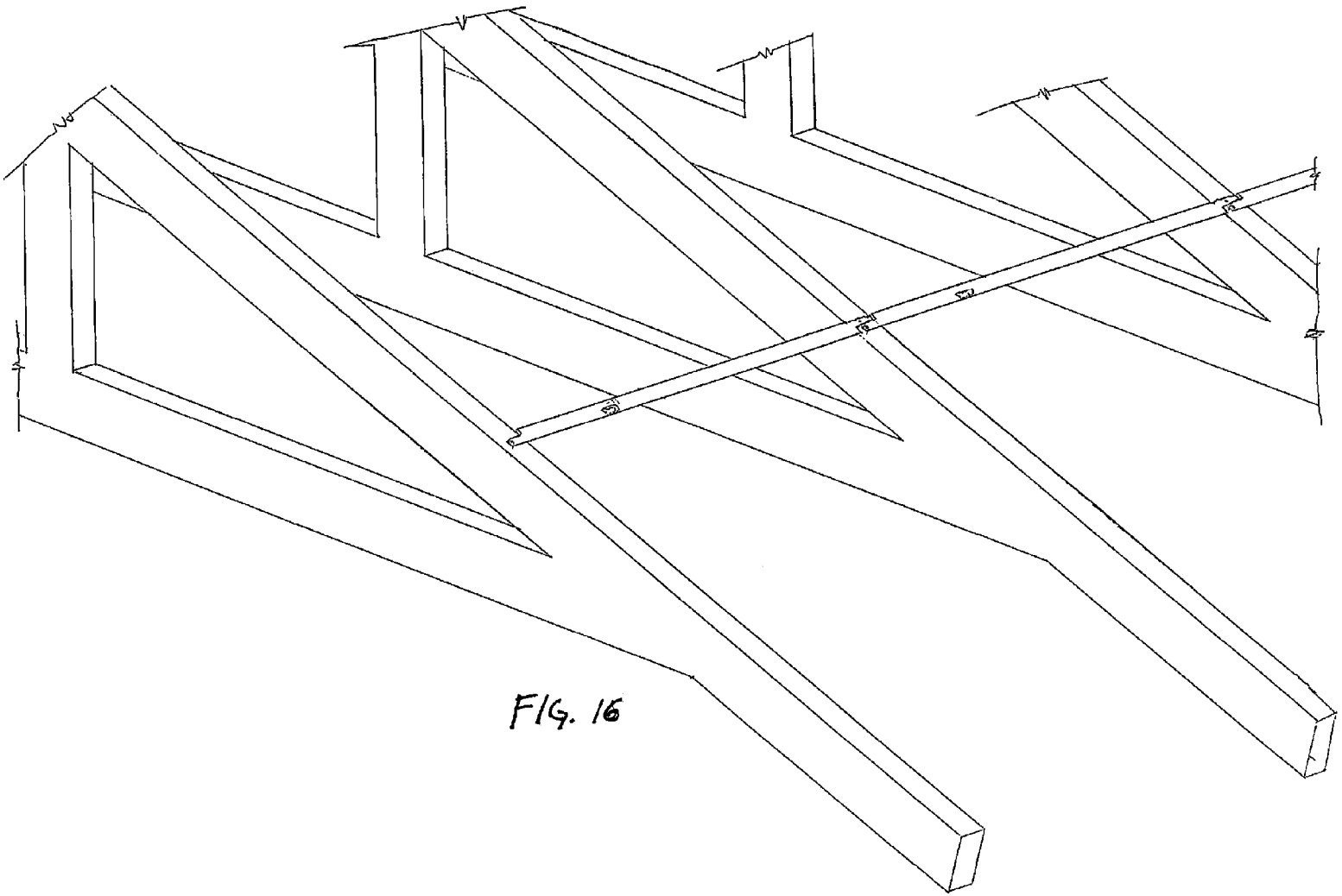
FIG. 16 is a perspective view of three trusses and spacers according to embodiments of the inventions herein.

FIG. 14 depicts three adjacent trusses having a truss spacer 40 fixed in place and another spacer 40' in a swinging rotation from a temporary transit position to the fixed position. Note that the end portions 46, 48 of truss spacers are aligned with one another. The alignment is attained without overlap and without necessarily abutting adjacent elongate members due to the offset and complementary cut-out features of each end portion 46, 48. As a result the overall structural support and the compact assembly between and among the trusses and the spacers are more uniform and conveniently attached.

Figure 17:
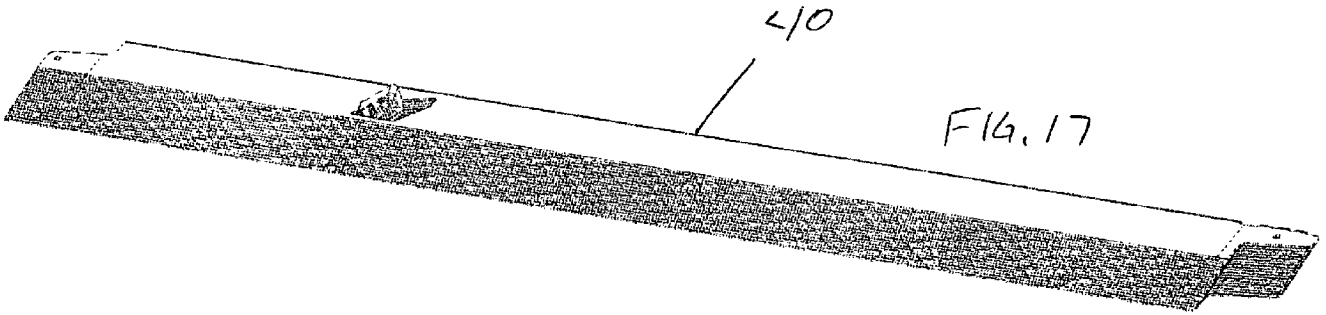
FIG. 17 is a perspective view of a stack of spacers nested together in accord with an embodiment of the invention.

FIG. 17 illustrates how an embodiment of spacers are stackable.

Figure 18:
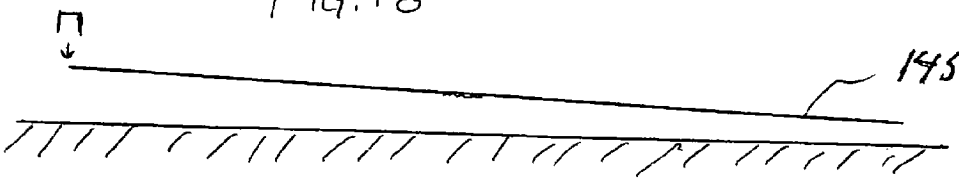
FIG. 18 is a side elevational cross sectional view of a spacer to be attached to a structural support member.
Figure 19:
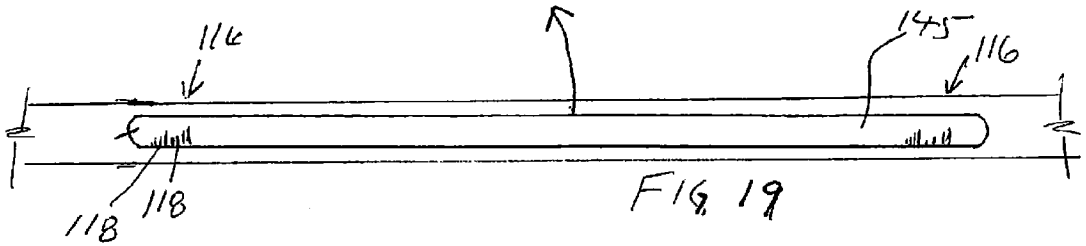
FIG. 19 is a view of the spacer of FIG. 18 attached to the member with a staple providing the pivot.

FIGS. 18 and 19 illustrate a spacer 145 embodiment where a single elongate strip of material with placement indicia 116 on each of a first end portion 146 and a second end portion 148 may be pivotally attached with a staple. One prong of a two prong staple extends through the penetratable first end. The spacer may be rotated about the one prong to swing to the adjacent truss and the graded indicators 118 may be used for positioning the second truss as described above.

"Upwardly" and upwardly facing" does not require the described element or surface to be horizontal, it may also be at any angle up to 90 degrees from horizontal.

All of the features disclosed in this specification (including any accompanying claims, abstract and drawings), and/or all of the steps of any method or process so disclosed, can be combined in any combination, except combinations where at least some of such features and/or steps are mutually exclusive.

Each feature disclosed in this specification (including any accompanying claims, abstract and drawings) can be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A unitary spacer for a pair of adjacent trusses, comprising:

a elongate member having an intermediate section, a first offset pivoting end and a second oppositely offset swing end opposing the first offset pivoting end, wherein the first pivoting end and the second swing end each include an aperture each of which is configured to receive an attachment component and wherein the elongate member comprises a first strip portion and a unitary second strip portion with a longitudinal bend therebetween providing the elongate member with an L-shaped cross section;

at least one intermediate transit tacking member formed integrally to the elongate member and disposed between the first pivoting end and the second swing end; and at least two discrete precision placement indicia disposed proximate the first pivoting end and the second swing end and adapted to indicate a linear spaced-apart relationship between the respective apertures of the first pivoting end and second swing end of the elongate member, wherein the second swing end includes at least one engagement structure formed integrally to the elongate member and configured to affix into one of the adjacent trusses; and wherein in profile the entirety of the spacer defines an L-shape but for the at least one intermediate transit tacking member.

2. The unitary spacer according to claim 1, wherein the elongate member is cut, formed, and fabricated from a single sheet of metal and is configured to lay flush against a top surface and a side surface of one of the pair of adjacent trusses.

3. The unitary spacer according to claim 1, wherein the at least two discrete precision placement indicia each are comprised of at least one of:

one or more cut-out features each including one of a V-shaped cut, an I-shaped cut, or other geometric or asymmetrically-shaped cut-out, a numbered or a lettered or a symbolic indicia indicating the relative spacing from one end of the elongate spacer to the other end and/or from a first indicia to an opposing indicia or set of indicia, installation instructions or directions relating to one of: a correct orientation, a stress or load-bearing rating for the elongate member, an incorrect orientation, and a listing of steps:

for untacking the at least one intermediate transit tacking member, for pivoting the elongate member, for temporarily affixing the elongate member at the second swing end, and for permanently affixing the elongate member at the second swing end.

4. The unitary spacer according to claim 1, wherein the second swing end comprises at least one prong for attachment to the other of the adjacent trusses when in a final position, and wherein the at least one prong is in alignment with the unitary second strip portion.

5. The unitary spacer according to claim 1, wherein the at least one intermediate transit tacking member comprises a prong unitary with the first strip portion, the prong insertable into a top surface of one of the pair adjacent trusses to secure the spacer in a temporary transport position.

6. The unitary spacer of claim 1 in combination with a stack of such spacers, the spacers nested together.

7. A unitary spacer for connecting between a pair of adjacent trusses, comprising:

an elongate member having an intermediate section, a first pivoting end and an opposite second swing end opposing the first pivoting end, wherein the elongate member comprises a first strip portion and a second strip portion unitary with the first strip portion, the first strip portion and the second strip portion defining a longitudinal bend therebetween providing the elongate member with an L-shaped cross section;

wherein the first strip portion is configured to fit flush against a top surface of one of the pair of adjacent trusses and the second strip portion is configured to fit flush on a side surface of the one of the pair of adjacent trusses defining a temporary transport position, the spacer swingable from said temporary transport position with the swing end rotatable away from the one of the pair of trusses to a position for connection to the other of the pair of adjacent trusses;

wherein the first strip portion comprises at least one transit tacking member formed integrally to the elongate member and disposed between the first pivoting end and the opposite second swing end, whereby the transit tacking member is configured to embed in one of the pair of adjacent trusses thereby temporarily securing the spacer in the temporary transport position;

wherein in profile the entirety of the spacer defines an L-shape but for the at least one transit tacking member.

8. The unitary spacer of claim 7 wherein the second swing end includes at least one prong formed integrally to the elongate member and configured to affix into the other of the pair of adjacent trusses, the at least one prong positioned in alignment with the second unitary strip portion from an end view.

9. The unitary spacer according to claim 7, wherein the elongate member is cut, formed, and fabricated from a single sheet of metal.

10. The unitary spacer according to claim 7, wherein each end has discrete precision placement indicia.

11. The unitary spacer according to claim 7, wherein the at least one intermediate transit tacking member comprises a prong coupled closer to the first end of the elongate member than the second end.

12. The unitary spacer of claim 7 in combination with a stack of such spacers, the spacers nested together.

13. The unitary spacer according to claim 7, wherein the first pivoting end and opposite second swing end are unitary with the first strip portion and one of the first pivoting end and opposite second swing end is laterally offset from the other.

14. The unitary spacer according to claim 12, wherein the first pivoting end and opposite second swing end have complementary shapes such that a series of such spacers are configured to be attached to a series of trusses in horizontal alignment.

15. A unitary spacer in combination with first and second adjacent trusses, comprising:

an elongate member having an intermediate section, a first pivoting end and an opposite second swing end opposing the first pivoting end, wherein the elongate member comprises a first strip portion and a second strip portion unitary with the first strip portion, the first strip portion and the second strip portion defining a longitudinal bend therebetween providing the elongate member with an L-shaped cross section;

wherein the first strip portion comprises at least one transit tacking member formed integrally with the elongate member and disposed between the first pivoting end and the opposite second swing end;

wherein in a temporary transport position of the spacer, the first strip portion fits flush against a top surface of the first truss, the transit tacking member is embedded in the top surface of the first truss to temporarily secure the spacer in the temporary transport position over the top surface of the first truss, the second strip portion fits flush on a side surface of the first truss, and the first pivoting end is attached to the top surface of the first truss to allow the spacer to swing from said temporary transport position with the swing end rotatable away from the first truss to a position for connection to the second truss;

wherein in a connected position of the spacer, the spacer spans between the first and second adjacent trusses, the first pivoting end remains attached to the top surface of the first truss, and the second swing end is attached to a top surface of the second truss;

wherein in profile the entirety of the spacer defines an L-shape but for the at least one transit tacking member.

16. The combination of claim 15, wherein:

the second swing end includes at least one prong formed integrally to the elongate member;

in the connected position of the spacer, the at least one prong is embedded in the top surface of the second truss;

in the temporary transport position of the spacer, the at least one prong fits flush on the side surface of the first truss.

17. The combination of claim 16, wherein the at least one prong is coplanar with the second strip portion such that in profile the entirety of the spacer defines the L-shape but for the at least one transit tacking member.

18. The combination of claim 15, wherein the first pivoting end defines an aperture configured to receive a fastener defining a pivot point about which the spacer swings from the temporary transport position to the connected position.

19. The combination of claim 15, wherein the second strip portion is disposed between and separates the first and second trusses when the spacer is in the temporary transport position.

20. The combination of claim 15, wherein the first strip portion of the spacer is generally planar except for the transit tacking member, and the second strip portion of the spacer is generally planar, such that the spacer is configured to nest closely with an identical spacer when disconnected from the first and second trusses.

* * * * *